US006945879B2

(12) United States Patent
Simonutti et al.

(10) Patent No.: US 6,945,879 B2
(45) Date of Patent: Sep. 20, 2005

(54) MULTI-LAYERED BALANCED GOLF-BALL

(75) Inventors: Frank M. Simonutti, Jackson, TN (US); Wayne R. Bradley, Trenton, TN (US)

(73) Assignee: Wilson Sporting Goods Co., Chicago, IL (US)

( * ) Notice: Subject to any disclaimer, the term of this patent is extended or adjusted under 35 U.S.C. 154(b) by 125 days.

(21) Appl. No.: 10/226,032

(22) Filed: Aug. 22, 2002

(65) Prior Publication Data

US 2004/0038752 A1 Feb. 26, 2004

(51) Int. Cl.[7] ..... A63B 37/04; A63B 37/06; A63B 37/12; A63B 37/14

(52) U.S. Cl. ..... 473/374; 473/378

(58) Field of Search ..... 473/351–378

(56) References Cited

U.S. PATENT DOCUMENTS

| | | | | | |
|---|---|---|---|---|---|
| 2,259,060 | A | | 10/1941 | Brown | |
| 2,741,480 | A | | 4/1956 | Elyria | |
| 4,111,038 | A | * | 9/1978 | Olson et al. | 73/65.02 |
| 4,442,282 | A | | 4/1984 | Kolycheck | 528/83 |
| 4,928,516 | A | * | 5/1990 | Movick | 73/65.02 |
| 4,984,804 | A | | 1/1991 | Yamada et al. | 524/908 |
| 5,222,739 | A | | 6/1993 | Horiuchi et al. | |
| 5,314,187 | A | | 5/1994 | Proudfit | |
| 5,497,996 | A | | 3/1996 | Cadorniga | |
| 5,580,057 | A | * | 12/1996 | Sullivan et al. | 473/377 |
| 5,589,546 | A | | 12/1996 | Hiraoka et al. | 525/193 |
| 5,605,968 | A | | 2/1997 | Egashira et al. | 525/221 |
| 5,779,561 | A | | 7/1998 | Sullivan et al. | 473/373 |
| 5,782,707 | A | | 7/1998 | Yamagishi et al. | 473/374 |
| 5,795,247 | A | | 8/1998 | Yokota et al. | 473/374 |
| 5,820,487 | A | * | 10/1998 | Nakamura et al. | 473/374 |
| 5,846,142 | A | * | 12/1998 | Kakiuchi et al. | 473/354 |
| 5,876,294 | A | * | 3/1999 | Yamagishi et al. | 473/374 |
| 5,929,189 | A | | 7/1999 | Ichikawa et al. | 528/76 |
| 5,935,022 | A | | 8/1999 | Sugimoto et al. | 473/373 |
| 5,967,908 | A | * | 10/1999 | Yamagishi et al. | 473/373 |
| 5,971,871 | A | | 10/1999 | Sullivan et al. | 473/373 |
| 5,984,806 | A | | 11/1999 | Sullivan et al. | 473/373 |
| 5,998,506 | A | | 12/1999 | Nesbitt | 523/219 |
| 6,010,412 | A | | 1/2000 | Moriyama | 473/373 |
| 6,015,351 | A | | 1/2000 | Elcock et al. | 470/10 |
| 6,045,461 | A | | 4/2000 | Yamagishi et al. | 473/377 |
| 6,071,201 | A | * | 6/2000 | Maruko | 473/373 |
| 6,083,120 | A | * | 7/2000 | Umezawa et al. | 473/356 |
| 6,106,415 | A | | 8/2000 | Masutani et al. | 473/374 |
| 6,129,640 | A | | 10/2000 | Higuchi et al. | 473/374 |
| 6,142,888 | A | | 11/2000 | Higuchi et al. | 473/374 |
| 6,152,836 | A | | 11/2000 | Bradley et al. | 473/378 |
| 6,156,843 | A | | 12/2000 | Yokota | 525/221 |
| 6,210,293 | B1 | | 4/2001 | Sullivan | 473/374 |
| 6,213,894 | B1 | | 4/2001 | Sullivan et al. | 473/374 |
| 6,261,193 | B1 | | 7/2001 | Sullivan et al. | 473/377 |
| 6,270,428 | B1 | | 8/2001 | Kuttappa | 473/367 |
| 6,315,681 | B1 | | 11/2001 | Sullivan | 473/373 |
| 6,315,682 | B1 | | 11/2001 | Iwami et al. | 473/374 |

FOREIGN PATENT DOCUMENTS

| | | |
|---|---|---|
| EP | 1 084 736 | 8/2000 |

* cited by examiner

*Primary Examiner*—Gregory Vidovich
*Assistant Examiner*—Alvin A. Hunter, Jr.
(74) *Attorney, Agent, or Firm*—Terence P. O'Brien

(57) ABSTRACT

A golf ball includes a core, an intermediate layer and a cover. The core is formed of a first composition, the intermediate layer is formed of a second composition, and the cover is formed of a third composition. The specific gravity of each of the first, second and third compositions are generally equal to each other. The first, second, and third compositions are each sufficiently mixed such that the ball exhibits random orientation when floated in a solution of sufficient density to support the ball.

28 Claims, 2 Drawing Sheets

MULTI-LAYERED BALANCED GOLF-BALL

FIELD OF THE INVENTION

The present invention relates generally to a multi-layered, balanced golf ball. In particular, the present invention relates to a balanced three-piece golf ball wherein the three pieces are formed of separate compositions, which have substantially the same specific gravity.

BACKGROUND OF THE INVENTION

Golf balls are well known sporting goods articles which have evolved over the years. Golf balls made prior to the late 1960's typically included a rubber center, a layer of thread rubber windings surrounding the center to form a wound core, and a rubber cover that covered the wound core. The cover was typically formed of a balata rubber (transpolyisoprene, natural or synthetic rubbers). In the late 1960's, DuPont® introduced ionomers under the trade name Surlyn®. Ionomers, such as Surlyn® and related products, such as Iotek® produced by Exxon® Corporation, have been used as a cover material for the majority of golf balls produced since the late 1960's. The use of ionomers in the production of golf ball covers led the way to the development of "two-piece" golf balls, which comprise a solid core and a cover. More recently, thermoplastic and thermoset (castable) polyurethanes have been utilized in the formation of golf ball covers, including golf balls with wound or solid cores. The use of these materials has also led to the proliferation of many multi-layer solid core golf ball constructions wherein two or more layers are applied over a solid core.

Existing two-piece, and multi-layer, golf balls have some drawbacks. All of the various materials used in the construction of golf balls, from wound core constructions through to multi-layer solid core constructions, have varying densities. Accordingly, the mass or weight per unit volume of these materials varies. For example, typically, the materials used to produce the cover layer often possess a greater weight or mass per unit volume than the materials used to produce the core. Additionally, the material composition of most intermediate layers has a density or a weight per unit volume that is different than the density or weight per unit volume of the core and/or the cover layer. If a golf ball is manufactured perfectly, that is if the core or center of a ball is centered exactly, and if the cover layer thickness, and intermediate layer thickness (if applicable), are constant throughout the entire ball, the ball will be "balanced", and should fly true when struck with a golf club, or should roll true when putted.

However, in the manufacturing of a golf ball, it is very difficult to ensure that a core of the golf ball is exactly and perfectly centered within the ball. Moreover, it is also very difficult to ensure that the thickness of the cover layer, and the thickness of the intermediate layer(s) of multi-piece balls, are uniform and consistent about the periphery of the core. Further, it is also difficult to ensure that the materials comprising the cover layer, and the intermediate layer (if applicable), are properly and sufficiently mixed or homogenized such that the composition and density of the cover layer or intermediate layer is consistent throughout the ball.

Golf balls typically exhibit or possess some degree of manufacturing inconsistency. A two-piece, or multi-piece, golf ball typically includes a core that is not exactly and perfectly centered, a cover layer that does not have a uniform thickness or composition, or an intermediate layer that does not have a uniform thickness or composition. Importantly, these manufacturing inconsistencies can negatively affect the performance of the golf ball.

One common attribute of most golf balls with manufacturing inconsistencies or deficiencies is that such balls will have a heavy spot, or heavy side, and a light spot, or light side. When a golf ball is produced from two or more pieces of varying densities, it is likely that the golf ball will have a light and heavy side. Testing has indicated that if a ball is oriented with the heavy side to one side, erratic behavior in flight properties, and in putting accuracy, can result. Generally, the ball will tend to move toward the direction in which the heavy side is oriented. Such a problem is common in most commercially available golf balls, and is detrimental to the golfer. The imbalance exhibited by the heavy and light spots of a golf ball can cause a putt to veer off line or an iron or driver shot to "hook" or "slice" off of its intended path. Additionally, when a ball is unbalanced, it generally fails to follow a true trajectory and its total flight distance is often negatively affected.

Thus, there is a continuing need for a golf ball that is perfectly balanced and won't depart from its intended flight or roll path due to an off-center core or outer layers of inconsistent thickness. What is needed is a golf ball that does not possess a heavy and light side due to manufacturing inconsistencies and, therefore, flies and putts true. It would be advantageous to develop a true, balanced golf ball that can be readily mass-produced. There is also a need for a golf ball having a cover layer and an intermediate layer (if applicable) of uniform density without areas of uneven material distribution.

SUMMARY OF THE INVENTION

The present invention provides a golf ball including a core, an intermediate layer and a cover. The core is formed of a first composition, the intermediate layer is formed of a second composition, and the cover is formed of a third composition. The specific gravity of each of the first, second and third compositions are generally equal to each other. The first, second, and third compositions are each sufficiently mixed such that the ball exhibits random orientation when floated in a solution of sufficient density to support the ball.

According to a principal aspect of the invention, a three-piece golf ball includes a core, an intermediate layer, and a cover layer. The core has a diameter within the range of 1.37 and 1.475 inches and a defection within the range of 0.120 to 0.140 inches under an applied load of 200 pounds. The intermediate layer has an outside diameter within the range of 1.55 to 1.6 inches and a hardness within the range of 58 to 64 on a Shore D hardness scale. The intermediate layer is formed of a terpolymer of ethylene, an $\alpha$, $\beta$-ethylenically unsaturated carboxlyic acid, and an n-alkyl acrylate. One hundred percent of the acid groups are neutralized with metal ions. The cover layer is formed of a thermoset rubber. The thermoset rubber includes a mixture of high cis-1,4 polybutadiene, trans-polyisoprene and polyurethane rubber. The cover layer has a thickness within the range of 0.040 to 0.65 inches and a hardness within the range of 48 to 62 on a Shore D Hardness Scale.

According to another preferred aspect of the invention a golf ball includes a core, an intermediate layer and a cover layer. The core is formed of a high cis-1,4 content polybutadiene, 20 to 28 parts by weight of a co-crosslinking agent, 3 to 5 parts by weight of a metal oxide activator, 0.8 to 1.5 phr of a free radical initiator, and a first predetermined amount of inorganic fillers sufficient to produce a specific gravity of the core within the range of 1.12 to 1.13. The intermediate layer is formed of a terpolymer and a second predetermined amount of inorganic fillers sufficient to produce a specific gravity of 1.1175 to 1.1325. The terpolymer includes 70–80% ethylene, 8–10.5% acrylic acid and 12–20% n-butyl acrylate. One hundred percent (100%) of the carboxylic acid groups are neutralized with metal ions. The cover layer is formed of 100 phr rubber, 30–40 phr of a crosslinking agent, 0.5 to 6 phr by weight of a free-radical initiator, and a third predetermined amount of inorganic fillers sufficient to produce a specific gravity of the cover layer with the range of 1.12 to 1.13. The cover has a hardness of 48 to 62 on a Shore D Hardness Scale, and a thickness of 0.040 to 0.65 inches.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
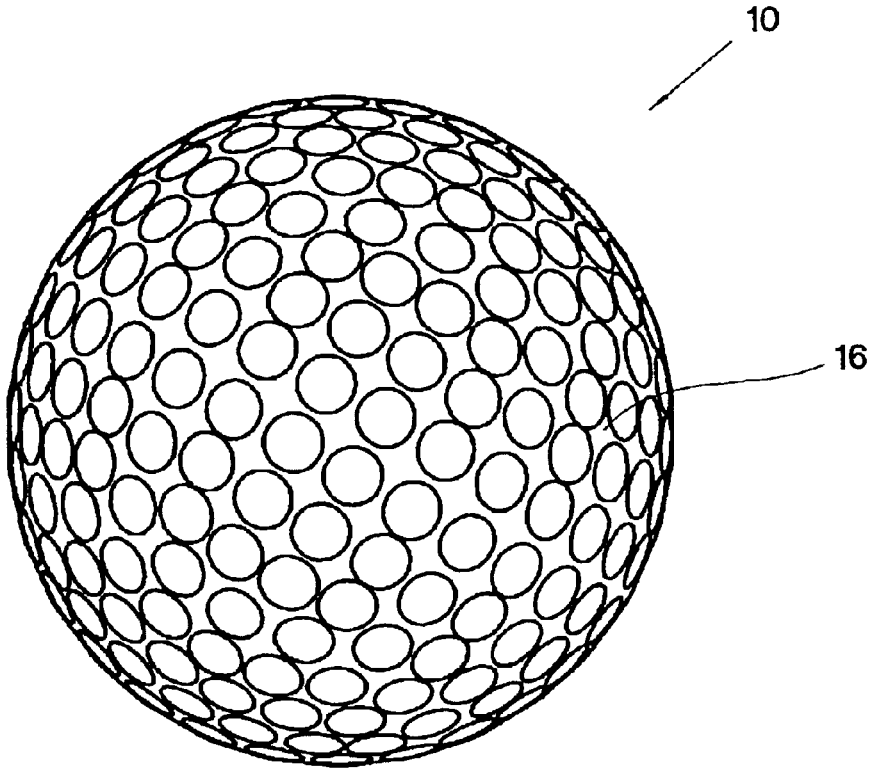
FIG. 1 a front view of a golf ball in accordance with a preferred embodiment of the present invention.
Figure 2:
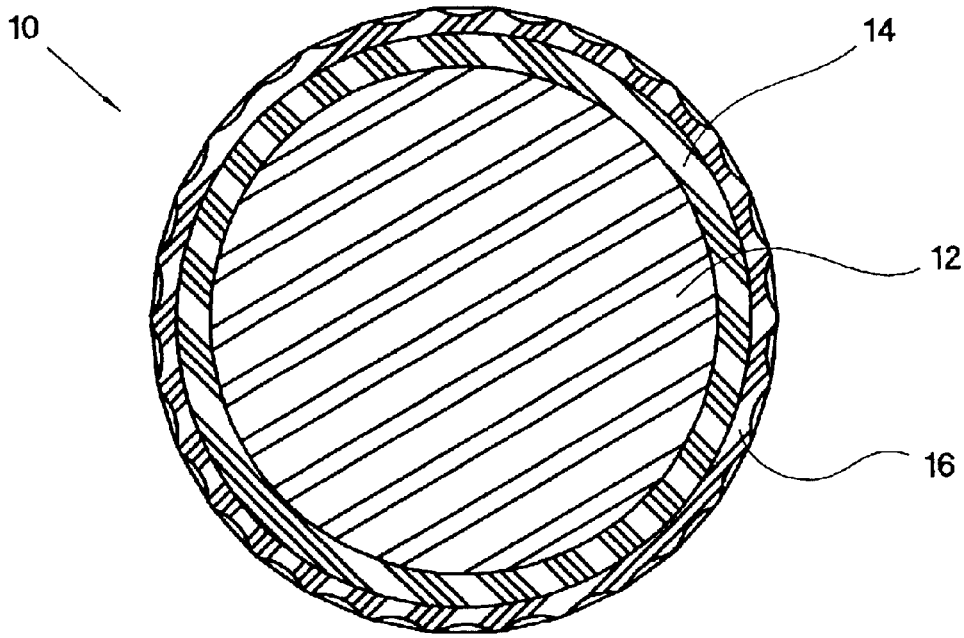
FIG. 2 is a cross-sectional view of the golf ball of FIG. 1.

The present invention relates to an improved multi-layered golf ball, and, in particular, a balanced multi-layered golf ball. Referring to FIGS. 1–2, a preferred embodiment of a multi-layered golf ball is indicated generally at 10. The ball 10 includes a core 12, an intermediate layer 14 and a cover layer 16.

The core 12 is a substantially spherical, generally solid member positioned at the geometric center of the ball 10. The core 12 is formed of a high cis-1,4 content polybutadiene, a co-crosslinking agent, a metal oxide activator, a free radical initiator, and sufficient amounts of inorganic fillers to produce the desired core specific gravity of 1.12 to 1.13. The co-crosslinking agent improves the stiffness and resiliency of the core. In a preferred embodiment, the core composition includes 20–28 parts by weight of the co-crosslinking agent. In a particularly preferred embodiment, the co-crosslinking agent is a zinc salt of an unsaturated acrylate. The zinc salt of an unsaturated acrylate can be approximately 92 percent zinc diacrylate and 8 percent stearate.

The composition of the core also preferably includes 3–5 parts by weight of the metal oxide activator and 0.8–1.5 phr of the free radical initiator. In a particularly preferred embodiment, the metal oxide activator is a zinc oxide and the free radical initiator is a peroxide. In addition to serving as an activator, zinc oxide also enables the composition of the core 12 to cure faster thereby reducing the manufacturing time of the core 12. The free-radical initiator can be 1,1 Di-(tert-butylperoxy)-3,3,5-trimethylcyclohexane. A 40 percent active version of this peroxide is available from Akzo Nobel under the tradename Triganox® 29/40. In alternative embodiments, other amounts of one or more of the cross-linking agent, the metal oxide activator and the free radical initiators can be used. Additionally, alternative cross-linking agents, metal oxide activators and free radical initiators can also be used.

In a preferred embodiment, the inorganic fillers used in the core are comprised of zinc oxide, barium sulfate or a combination thereof. The total amount of the inorganic fillers to produce a core specific gravity of 1.12 to 1.13 is within the range of 10 to 14 phr. In a particularly preferred embodiment, 11 to 13 phr of the inorganic fillers are used to produce a core composition of the desired specific gravity.

The composition of the core 12 is mixed, molded and then glebarred to a desired diameter. In a preferred embodiment, the core 12 has an outside diameter within the range 1.37 to 1.475 inches, and a deflection of between 0.120 and 0.140 inches under an applied load of 200 lbs. The core 12 can also be formed in other sizes and can have a compression or deflection value outside of 0.120 and 0.140 inches under an applied load of 200 lbs.

The intermediate layer 14 is a spherical mantle that encompasses the core 12. The intermediate layer 14 is molded about the core 12. Preferably, the intermediate layer 14 is injection molded about the core 12. The intermediate layer 14 is formed of a terpolymer and sufficient amounts of inorganic fillers to produce the desired intermediate layer specific gravity of 1.1175 to 1.1325. In one particularly preferred embodiment, the specific gravity of the intermediate layer is within the range of 1.12 to 1.13. The terpolymer comprises ethylene, acrylic acid and n-butyl acrylate. In a preferred embodiment, the composition of the intermediate layer 14 includes 70 to 80 percent ethylene, 8 to 10.5 percent acrylic acid and 12 to 20 percent n-butyl acrylate.

In a preferred embodiment, 100 percent of the carboxylic acid is neutralized with metal ions. The metal ions used to neutralize the carboxylic acid groups are preferably magnesium ions. Other types of metal ions can also be used, such as, for example, lithium, sodium, zinc, potassium, etc. Neutralization of the carboxylic acid increases the resiliency and stiffness of the intermediate layer 14, while maintaining the workability of the composition of the intermediate layer 14 (the ability to mold or melt the composition). In a particularly preferred embodiment, the terpolymer is DuPont® product number AD1016, produced and provided by E. I. duPont de Nemours and Company.

The terpolymer is compounded with the inorganic fillers to produce the desired intermediate layer specific gravity of 1.1175 to 1.1325. In a preferred embodiment, the inorganic fillers used in the intermediate layer 14 are comprised of barium sulfate, titanium dioxide, or a combination thereof. The total amount of the inorganic fillers to produce an intermediate layer specific gravity of 1.1175 to 1.1325 is within the range of 17 to 27 phr. In a particularly preferred embodiment, 19 to 25 phr of the inorganic fillers is used to produce an intermediate layer composition of the desired specific gravity. Barium sulfate and titanium dioxide are generally white and, therefore, advantageously whiten the composition of the intermediate layer 14. In alternative embodiments, other fillers can be used, such as, for example, zinc oxide and calcium carbonate.

The fillers and terpolymer of the intermediate layer 14 are thoroughly mixed to ensure even distribution. In a preferred embodiment, the composition of the intermediate layer 14 is compounded using compounding equipment, such as, for example, a twin screw extruder or other compounding machine. The compounding equipment, such as the twin screw extruder, advantageously and thoroughly mix the composition of the intermediate layer 14 to produce a homogenous intermediate layer 14 having substantially uniform material distribution. The uniformly mixed and evenly distributed intermediate layer 14 contributes to the production of a balanced golf ball. Simply adding material into an injection press barrel results in insufficient mixing to produce a homogeneous specific gravity. The variability of a material that is simply added into an injection press barrel is large enough to cause an "imbalance" in the ball when tested. However, the material compounded with a twin screw extruder does have sufficient mixing and low variability to produce a homogeneous specific gravity.

The intermediate layer 14 is formed to a desired diameter and hardness. In a preferred embodiment, the intermediate layer 14 has an outside diameter within the range 1.55 to 1.60 inches, and a hardness within the range of 58 to 64 on the Shore D hardness scale. The intermediate layer 14 can also be formed in other sizes and with a hardness outside of 58 to 64 on the Shore D hardness scale.

The cover layer 16 is a spherical covering that encompasses the intermediate layer 14 and the core 12. The cover layer 16 is molded about the intermediate layer 14. Preferably, the cover layer 16 is formed into half shells, and then compression molded in conjunction with the intermediate layer 14 about the core 12. The cover layer 16 is formed of a thermoset rubber composition. Preferably, the cover layer 16 includes a mixture of cis-1,4 poly butadiene, trans-polyisoprene and polyurethane rubber, a cross linking agent, a free-radical initiator, and sufficient amounts of inorganic fillers to produce the desired cover layer specific gravity of 1.12 to 1.13.

In a preferred embodiment, 100 parts per hundred parts rubber ("phr") of the thermoset rubber composition includes 40–60 percent by weight polybutadiene, 40–60 percent by weight trans-polyisoprene, and 0–10 percent by weight of a polyurethane rubber. In a particularly preferred embodiment, the cover layer 16 is comprised of 40 phr polybutadiene, 55 phr trans-polyisoprene and 5 phr polyurethane rubber.

In a preferred embodiment, the composition of the cover layer 16 includes 30–40 phr of the crosslinking agent. In a particularly preferred embodiment, the crosslinking agent is a zinc salt of an unsaturated acrylate including a zinc diacrylate and zinc stearate. The composition of the cover layer 16 also preferably includes 0.5–6.0 phr by weight of the free radical initiator. The preferred free-radical initiator is Butyl 4,4'-di-(tert-butylperoxy) valerate. This peroxide (free-radical initiator) is available from R. T. Vanderbilt under the tradename Varox® 230XL, or from Akzo Nobel under the tradename Triganox® 17/40. In alternative embodiments, other amounts of one or more of the cross-linking agent, and the free radical initiators can be used. Additionally, alternative cross-linking agents and free radical initiators can also be used.

In a preferred embodiment, the inorganic fillers used in the cover layer 16 are comprised of zinc oxide, barium sulfate, titanium dioxide, or a combination thereof. The total amount of the inorganic fillers to produce a cover layer specific gravity of 1.120 to 1.13 is within the range of 7 to 12 phr. In a particularly preferred embodiment, 8.5 to 10.5 phr of the inorganic fillers are used to produce a cover layer composition of the desired specific gravity. In one preferred embodiment, the composition of the cover layer 16 includes at least 9 parts by weight of inorganic fillers per 100 parts by weight of the cover layer composition. Zinc oxide, barium sulfate and titanium dioxide are generally white and, therefore, advantageously whiten the composition of the cover layer 16. The use of the white colored fillers can substantially reduce or eliminate the need to apply a primer coat or an outer coat to whiten the outer surface of the ball 10. To produce the desired color, a small amount of color concentrate may also be added to the cover.

The cover layer 16 is formed to a desired thickness and hardness. In a preferred embodiment, the cover layer 16 has thickness within the range 0.040 to 0.055 inches, and a hardness within the range of 50 to 62 on the Shore D hardness scale. The cover layer 16 can also be formed in other sizes and with a hardness outside of 50 to 62 on the Shore D hardness scale.

The core 12, the intermediate layer 14 and the cover layer 16 combine to produce the ball 10 which has a weight of between 45.0 and 45.93 grams, a deflection of between 0.085 and 0.105 inches under an applied load of 200 lb., and a specific gravity of 1.120 to 1.130. Preferably, the specific gravities of the three component parts of the ball (the core, intermediate layer and cover layer) are within 0.008 of each other. In alternative preferred embodiments, the core, intermediate layer and cover layer of the ball can be formed of compositions having different, but substantially equivalent, specific gravity values.

The ball of the present invention putts and flies truer upon impact than unbalanced balls. By maintaining the specific gravity of the core, the intermediate layer and the cover layer substantially equal, and by ensuring proper homogenous mixing of the component parts of the intermediate layer, as well as the cover and the core, the ball of the present invention also exhibits a random orientation when "floated" in a solution of sufficient density to support the ball. In other words, the ball of the present invention is balanced and does not include heavy or light spots that can negatively affect the performance of the ball. The configuration of the ball enables the ball to be balanced even if the core, the intermediate layer or the cover layer include minor manufacturing inconsistencies, in their shape, orientation or thickness. Thus, the balanced ball of the present invention can be readily mass-produced while maintaining true and consistent ball performance characteristics.

The "float" test referred to above can be performed in the following manner. First a container, preferably a transparent or semi-transparent container, is substantially filled with warm water. A salt, such as Epsom Salt, is then added to the solution in a sufficient amount to enable one or more golf balls to float in the solution. The solution preferably has a specific gravity within the range of 1.14 to 1.20. Best results are obtained when a lubricant, such as a detergent, is added to the salt water solution to reduce friction between the outer surface of the golf ball and the solution. In a particularly preferred method, a few drops of Jet Dry detergent are added to the solution. A golf ball is then placed into the solution and spun. When the ball stops spinning the upper most portion of the ball is marked with a marker or otherwise identified. The ball is then spun again in the solution and the upper most portion of the ball is again marked or identified. The ball can then be spun additional times to obtain additional results.

An unbalanced ball will generally have a light spot and a heavy spot. When an unbalanced ball is repeatedly spun in the salt water solution of the float test described above, the ball will tend to consistently orient itself in the solution with its light spot up and its heavy spot down. In contrast, a balanced golf ball will exhibit a random orientation when "floated" in a solution of sufficient density to support the ball. The random orientation in the test solution is indicative of the absence of a light or heavy spot within the balanced golf ball.

The ball 10 also fully conforms to the United States Golf Association® ("USGA®") requirements for golf balls specified in the USGA®, "The Rules of Golf And The Rules Of Amateur Status 2002–2003", effective Jan. 1, 2002, which is incorporated by reference. Appendix III of the USGA® Rules of Golf includes the following ball requirements:

1. Weight

The weight of the ball shall not to be greater than 1.620 ounces avoirdupois (45.93 gm).

2. Size

The diameter of the ball shall not be less than 1.680 inches (42.67 mm). This specification will be satisfied if, under its own weight, a ball falls through a 1.680 inches diameter ring gauge in fewer than 25 out of 100 randomly selected positions, the test being carried out at a temperature of 23 +/−1 degree C.

3. Spherical Symmetry

The ball must not be designed, manufactured or intentionally modified to have properties which differ from those of a spherically symmetrical ball.

4. Initial Velocity

The initial velocity of the ball shall not exceed the limit specified (test on file) [250 ft/s +2%, or 255.0 ft/s] when measured on apparatus approved by the United States Golf Association.

5. Overall Distance Standard

The combined carry and roll of the ball, when tested on apparatus approved by the United States Golf Association, shall not exceed the distance specified under the conditions set forth in the Overall Distance Standard for golf balls on file with the United States Golf Association.

The present invention is further illustrated by the following example. The present invention is not limited to the following example, and various changes and modifications may be made in the invention without departing from the spirit and scope thereof.

EXAMPLE 1

The Example 1 golf balls were designed and produced in accordance with the present invention. The Example 1 balls were made with the following core composition. "Phr" refers to number of parts by weight per 100 parts by weight of rubber.

Core Formula:

| Material | Phr |
|---|---|
| Enichem BR-40 Polybutadiene | 97.5 |
| Adiprene FM Polyurethane Rubber | 2.5 |
| SR416D Zinc Diacrylate | 26 |
| Zinc Oxide | 5 |
| Zinc Stearate | 3 |
| Triganox 29/40 | 2.05 |
| Barytes | 7.5 |

The core of each Example 1 ball was mixed and molded to this formulation, and glebarred to 1.375" diameter. After centerless grinding or glebarring, the cores had a size of 1.374", a weight of 24.94 g, a deflection of 0.128" under an applied load of 200 lb., and a specific gravity of 1.121.

The intermediate layer of each of the Example 1 balls was molded using a terpolymer comprising ~76.5% ethylene, ~8.5% acrylic acid and ~15% n-butyl acrylate, wherein 100% of the acid groups were neutralized with magnesium ions. The terpolyer material of the intermediate layer is DuPont® product number AD1016, produced and provided by E. I. duPont de Nemours and Company. The terpolymer was compounded with barium sulfate and titanium dioxide to a specific gravity of 1.125. The terpolymer was compounded using a twin screw extruder. The material compounded with a twin screw extruder has sufficient mixing and low variability to produce a homogeneous specific gravity.

The covers of the Example 1 balls were made using the following formula:

Cover Formula:

| Material | Phr |
|---|---|
| Enichem BR-40 Polybutadiene | 40 |
| TP-301 Trans-polyisoprene | 55 |
| Millathane 97 polyurethane rubber | 5 |
| SR416D Zinc Diacrylate | 35 |
| Titanium Dioxide | 3 |
| Zinc Oxide | 3.3 |
| Zinc Stearate | 1.5 |
| Varox ® 230XL | 1.5 |
| UMB 42MBO2 Blue Pigment | 0.1 |

The covers compounded under the above-listed formula were molded into "half-shells". The core and intermediate layer pieces were then inserted into half-shells, and the balls were compression molded.

The balls of Example 1 were then tested for physical properties against competitive products. Table 1 lists the results of the physical properties test.

TABLE 1

Physical Properties:

| Ball | Size | Defl. | Weight | Shore 'D' | Coefficient Of Restitution 125 f/s | 150 f/s | 175 f/s | I.V. |
|---|---|---|---|---|---|---|---|---|
| Example 1 | 1.6839" | 0.0995" | 45.30 | 54 | 0.794 | 0.767 | 0.738 | 255.5 |
| Titleist Pro V1 | 1.6797" | 0.0969" | 45.58 | 59 | 0.795 | 0.765 | 0.737 | 254.3 |
| Titleist NXT Tour | 1.6807" | 0.1073" | 45.42 | 61 | 0.810 | 0.778 | 0.747 | 256.1 |
| Precept Tour Premium | 1.6802" | 0.0975" | 45.23 | 52 | 0.789 | 0.763 | 0.730 | 254.3 |
| Nike Tour Accuracy | 1.6814" | 0.0965" | 45.51 | 51 | 0.787 | 0.758 | 0.726 | 253.8 |

TABLE 1-continued

| Physical Properties: | | | | | | | | |
|---|---|---|---|---|---|---|---|---|
| | | | | Shore | Coefficient Of Restitution | | | |
| Ball | Size | Defl. | Weight | 'D' | 125 f/s | 150 f/s | 175 f/s | I.V. |
| Nike Tour Accuracy TW | 1.6809" | 0.0890" | 45.15 | 56 | 0.792 | 0.764 | 0.730 | 254.0 |
| Callaway Rule 35 SoftFeel | 1.6798" | 0.0894" | 45.40 | 56 | 0.784 | 0.758 | 0.726 | 252.7 |
| Maxfli A10 | 1.6825" | 0.1002" | 45.78 | 58 | 0.786 | 0.767 | 0.745 | 256.1 |
| Strata Tour Ultimate | 1.6829" | 0.0917" | 45.47 | 52 | 0.799 | 0.769 | 0.741 | 254.4 |

Hardness measurements were measured using a durometer in the Shore D scale manufactured by Shore Instruments. Hardness readings were taken at the surface of the ball. Deflection measurement were taken under a 200 lb. applied load, using Wilson Dead Weight Deflection testing machine.

"C.O.R. (125 ft/s)" refers to the ratio of outbound/inbound velocity with a 125 ft/s inbound velocity test setup. "C.O.R. (150 ft/s)" refers to the ratio of outbound/inbound velocity with a 150 ft/s inbound velocity test setup. "C.O.R. (175 ft/s)" refers to the ratio of outbound/inbound velocity with a 175 ft/s inbound velocity test setup. "Initial Velocity" was measured using the Wilson Initial Velocity Test Machine.

The golf ball of Example 1 yields comparable initial velocity, compression, C.O.R., etc. properties compared to competitive set tested.

TABLE 2

| Flight Performance Properties: | | | | | | |
|---|---|---|---|---|---|---|
| Ball | Carry Dist. | Total Dist. | Apogee | I.V. | Driver Spin | 9-I Spin |
| Example 1 | 240.7 | 249.6 | 10.0 | 232.3 | 3416 | 8408 |
| Titleist Pro V1 | 243.4 | 248.3 | 10.7 | 232.4 | 3376 | 7922 |
| Titleist NXT Tour | 245.0 | 252.1 | 10.4 | 232.2 | 3125 | 8264 |
| Precept Tour Premium | 238.4 | 247.8 | 10.0 | 231.0 | 3506 | 8423 |
| Nike Tour Accuracy | 238.7 | 245.6 | 10.0 | 230.4 | 3501 | 8461 |
| Nike Tour Accuracy TW | 241.9 | 249.7 | 10.1 | 232.4 | 3467 | 8261 |
| Callaway Rule 35 SoftFeel | 243.4 | 250.2 | 10.5 | 231.4 | 3480 | 7971 |
| Maxfli A10 | 242.6 | 249.0 | 10.2 | 232.5 | 3508 | 8481 |
| Strata Tour Ultimate | 241.7 | 248.5 | 10.3 | 232.7 | 3448 | 8125 |

The tests involving a driver and 9-iron were performed using a True Temper machine. The driver test results illustrated are an average of 4 tests wherein the clubhead velocity was 230 ft/sec and the launch angle was 10.5°. The 9-iron test results illustrated are an average of 2 tests wherein the clubhead velocity was 150 ft/sec and the launch angle was 25°.

The golf ball of Example 1 yields exceptional flight and spin properties compared to the competitive set. Distance, Spin rate (both Driver and 9-iron), and initial velocity properties are all comparable to or better than the majority of the competitive set.

A Putting Accuracy Test was also performed, at Wilson Golf Research Testing Facility, on the Example 1 balls under the following Test Set-Up and Test Design.

Test Set-up—The evaluation is performed by putting the balls with a pendulum style putting apparatus configured with a standard putter on a table sloped uphill at 1.0° and level from side to side. The surface of the table is overlaid with 21 oz. felt. A standard USGA regulation cup (4¼ inch in diameter) is sunk in the surface on the intended putting line and allows for an approximate 10' putt.

Test Design—Each golf ball in each dozen was putted 12 times. The test included two parts (6 putts per part):

(1) Each ball was oriented 3 times with the light spot LEFT and putted, and 3 times with the light spot RIGHT and putted.

(2) Each ball was randomly oriented and putted 6 times.

The testing was conducted in 6 rounds. Each round of testing constituted a dozen of each of the 28 ball types being putted. The ball types were putted one dozen at a time and pulled in random order during a given round. In all, a total of 24,192 putts were recorded.

TABLE 3

| Putting Accuracy Test Results: | | | | | | | | | |
|---|---|---|---|---|---|---|---|---|---|
| | Bridgestone Tour Stage U-Drive | Bridgestone Tour Stage AMZ | Callaway CB1 Red | Callaway CTU 30 Blue | Callaway CTU 30 Red | Callaway CB1 Blue | Dunlop New Breed Pro Wound | Dunlop XX10 Tour Special | Kasco Silicone Power |
| # of Dzn Tested | 6 | 6 | 6 | 6 | 6 | 6 | 6 | 6 | 6 |
| Oriented Missing Correctly (432 putts) | 30 | 66 | 115 | 43 | 20 | 186 | 265 | 97 | 68 |
| Oriented No. of Balls Missing 2X Correctly | 8 | 18 | 32 | 12 | 4 | 51 | 65 | 28 | 20 |

TABLE 3-continued

| Putting Accuracy Test Results: | | | | | | | | | |
|---|---|---|---|---|---|---|---|---|---|
| Oriented No. of Balls Missing 3X Correctly | 3 | 9 | 21 | 4 | 2 | 37 | 56 | 12 | 7 |
| Oriented No. of Balls Missing 4X Correctly | 0 | 2 | 7 | 1 | 0 | 23 | 38 | 7 | 2 |
| Oriented No. of Balls Missing 5X Correctly | 0 | 0 | 2 | 0 | 0 | 10 | 27 | 2 | 0 |
| Oriented No. of Balls Missing 6X Correctly | 0 | 0 | 0 | 0 | 0 | 3 | 12 | 2 | 0 |

| | Maxfli A10 | Maxfli Hi-Brid | Maxfli Noodle | Nike Power Distance | Nike Tour Accuracy | Nike Tour Accuracy TW | Precept Extra Spin | Precept MC Lady | Precept Tour Premium LS | Srixon Hi-Spin |
|---|---|---|---|---|---|---|---|---|---|---|
| # of Dzn Tested | 6 | 6 | 6 | 6 | 6 | 6 | 6 | 6 | 6 | 6 |
| Oriented Missing Correctly (432 putts) | 42 | 82 | 45 | 92 | 35 | 32 | 28 | 22 | 16 | 46 |
| Oriented No. of Balls Missing 2X Correctly | 9 | 23 | 9 | 26 | 8 | 4 | 7 | 6 | 2 | 12 |
| Oriented No. of Balls Missing 3X Correctly | 3 | 14 | 3 | 12 | 5 | 0 | 2 | 0 | 0 | 3 |
| Oriented No. of Balls Missing 4X Correctly | 0 | 2 | 1 | 4 | 0 | 0 | 0 | 0 | 0 | 1 |
| Oriented No. of Balls Missing 5X Correctly | 0 | 2 | 0 | 3 | 0 | 0 | 0 | 0 | 0 | 0 |
| Oriented No. of Balls Missing 6X Correctly | 0 | 2 | 0 | 0 | 0 | 0 | 0 | 0 | 0 | 0 |

| | Strata Tour Ultimate I | Strata Tour Ultimate II | Titleist NXT Distance | Titleist NXT Tour | Titleist Pro V1 | Titleist Tour Distance SF | Example 1 |
|---|---|---|---|---|---|---|---|
| # of Dzn Tested | 6 | 6 | 6 | 6 | 6 | 6 | 6 |
| Oriented Missing Correctly (432 putts) | 101 | 111 | 62 | 31 | 28 | 293 | 0 |
| Oriented No. of Balls Missing 2X Correctly | 30 | 30 | 19 | 3 | 6 | 66 | 0 |
| Oriented No. of Balls Missing 3X Correctly | 12 | 17 | 2 | 1 | 2 | 61 | 0 |
| Oriented No. of Balls Missing 4X Correctly | 6 | 6 | 1 | 0 | 0 | 47 | 0 |
| Oriented No. of Balls Missing 5X Correctly | 4 | 1 | 1 | 0 | 0 | 34 | 0 |
| Oriented No. of Balls Missing 6X Correctly | 1 | 0 | 0 | 0 | 0 | 16 | 0 |

The data illustrates that the ball of Example 1 performs the best among all balls in the category of "Correct Oriented Misses." "Correct Oriented Misses" means that balls putted with their heavy spot oriented to the right (and the light spot oriented to the left) missed the cup right, and vice versa if the heavy spot was oriented to the left. Every putt made with the balls of Example 1 was successfully made, and accordingly, none of the balls of Example 1 missed when putted. The balls of Example performed significantly better than competitive balls in putting accuracy as evaluated in this test.

The results of the Putting Accuracy and the Flight Performance Tests demonstrate that the balls of Example 1 are vastly superior to tested competitive balls in putting accuracy. Further, the balls of Example 1 also have exceptional performance characteristics that were equal to or better than the performance characteristics of competitive balls tested.

While the preferred embodiments of the present invention have been described and illustrated, numerous departures therefrom can be contemplated by persons skilled in the art. Therefore, the present invention is not limited to the foregoing description but only by the scope and spirit of the appended claims.

What is claimed is:

1. A golf ball comprising:

a core formed of a first composition;

an intermediate layer formed of a second composition, the second composition including a terpolymer including 70–80% ethylene, 8–10.5% acrylic acid and 12–20% n-butyl acrylate, and wherein 100% of the acrylic acid is neutralized with metal ions; and a cover layer formed of a third composition, the specific gravity of each of the first, second and third compositions being generally equal to each other, the first, second, and third compositions each being sufficiently mixed such that the ball exhibits random orientation when floated in a solution of sufficient density to support the ball.

2. The golf ball of claim 1, wherein the metal ions are magnesium ions.

3. The ball of claim 2, wherein the third composition comprises a polyurethane.

4. The ball of claim 3, wherein the cover layer has a hardness of 48–62 on a Shore D Hardness Scale and a thickness within the range of 0.040 to 0.65 inches.

5. The ball of claim 2, wherein the third composition includes 0–10% by weight polyurethane rubber.

6. A three-piece golf ball comprising:

a core having a diameter within the range of 1.37 and 1.475 inches and a defection within the range of 0.120 to 0.140 inches under an applied load of 200 pounds;

an intermediate layer having an outside diameter within the range of 1.55 to 1.6 inches, a hardness within the range of 58 to 64 on a Shore D hardness scale, the intermediate layer formed of a terpolymer of ethylene, an α, β ethylenically unsaturated carboxlyic acid, and an n-alkyl acrylate, wherein 100% of the carboxylic acid is neutralized with metal ions; and a cover layer formed of a thermoset rubber, the thermoset rubber including a mixture of high cis-1,4 polybutadiene, trans-polyisoprene and polyurethane rubber, the cover layer having a hardness of 48 to 62 on a Shore D Hardness Scale, a thickness within the range of 0.040 to 0.65 inches.

7. The golf ball of claim 6, wherein the specific gravity of the core within the range of 1.12 to 1.13, wherein the specific gravity of the intermediate layer is within the range of 1.1175 to 1.1325, and wherein the specific gravity of the cover layer is within the range of 1.12 to 1.13.

8. The golf ball of claim 6, wherein the rubber of the cover layer includes 40–60% by weight polybutadiene, 40–60% by weight trans-polyisoprene, and 0–10% by weight of a polyurethane rubber.

9. The golf ball of claim 8, wherein the rubber of the cover layer includes 40% by weight polybutadiene, 55% by weight trans-polyisoprene, and 5% by weight of a polyurethane rubber.

10. The golf ball of claim 8, wherein the third predetermined amount of inorganic fillers is at least 20 parts by weight per 100 parts by weight of the cover layer.

11. The golf ball of claim 6, wherein the ball has a weight of between 45.0 and 45.93 grams, wherein the ball has a deflection within the range of 0.085 to 0.105 inches under an applied load of 200 lbs, and wherein the specific gravity of the ball is within the range of 1.120 and 1.130.

12. The golf ball of claim 6, wherein the core, the intermediate layer, and the cover layer include the first, second and third predetermined amounts of inorganic fillers, respectively.

13. The golf ball of claim 12, wherein the first, second and third predetermined amounts of inorganic fillers are selected from the group consisting of zinc oxide, barium sulfate, titanium dioxide and combinations thereof.

14. The golf ball of claim 13, wherein the compositions of the core, intermediate layer and the cover layer are each sufficiently homogenized to ensure random orientation of the ball when the ball is floated in a solution of sufficient density to support the ball.

15. The golf ball of claim 13, wherein weight, size, spherical symmetry, initial velocity and overall distance of the ball conform to the United States Golf Association golf ball specifications, effective for the 2002–2003 golf season.

16. The golf ball of claim 13, wherein the third predetermined amount of inorganic fillers is at least 7 parts by weight per 100 parts by weight of the cover layer.

17. A golf ball comprising:

a core formed of a high cis-1,4 content polybutadiene, 20 to 28 parts by weight of a co-crosslinking agent, 3 to 5 parts by weight of a metal oxide activator, 0.8 to 1.5 phr of a free radical initiator, and a first predetermined amount of inorganic fillers sufficient to produce a specific gravity of the core within the range of 1.12 to 1.13;

an intermediate layer formed of a terpolymer including 70–80% ethylene, 8–10.5% acrylic acid and 12–20% n-butyl acrylate, wherein 100% of the acrylic acid is neutralized with metal ions, and a second predetermined amount of inorganic fillers sufficient to produce a specific gravity of 1.1175 to 1.1325; and a cover layer formed of 100 pbr rubber, 30–40 phr of a crosslinking agent, 0.5 to 6 phr by weight of a free-radical initiator, and a third predetermined amount of inorganic fillers sufficient to produce a specific gravity of the cover layer with the range of 1.12 to 1.13, the cover having a hardness of 48 to 62 on a Shore D Hardness Scale, and a thickness of 0.040 to 0.65 inches.

18. The golf ball of claim 17, wherein the metal oxide activator of the core is zinc oxide.

19. The golf ball of claim 17, wherein the co-crosslinking agent of the core comprises a zinc salt of an unsaturated acrylate.

20. The golf ball of claim 17, wherein the first, second and third predetermined amounts of inorganic fillers are selected from the group consisting of zinc oxide, barium sulfate, titanium dioxide and combinations thereof.

21. The golf ball of claim 17, wherein the 100 percent of the acrylic acid is neutralized with magnesium ions.

22. The golf ball of claim 17, wherein the rubber of the cover layer includes 40–60% by weight polybutadiene, 40–60% by weight trans-polyisoprene, and 0–10% by weight of a polyurethane rubber.

23. The golf ball of claim 22, wherein the rubber of the cover layer includes 40% by weight polybutadiene, 55% by weight trans-polyisoprene, and 5% by weight of a polyurethane rubber.

24. The golf ball of claim 17, wherein the ball has a weight of between 45.0 and 45.93 grams, and wherein the specific gravity of the ball is within the range of 1.120 and 1.130.

25. The ball of claim 17, wherein the core has a deflection within the range of 0.0120 to 0.140 inches under a load of 200 lbs, and wherein the ball has a deflection within the range of 0.085 to 0.105 inches under an applied load of 200 lbs.

26. The golf ball of claim 19, wherein the compositions of the core, intermediate layer and the cover layer are each sufficiently homogenized to ensure random orientation of the ball when the ball is floated in a solution of sufficient density to support the ball.

27. The golf ball of claim 17, wherein the core has a diameter within the range of 1.37 and 1.475 inches.

28. The ball of claim 17, wherein the third predetermined amount of inorganic fillers is at least 7 parts by weight per 100 parts by weight of the cover layer.

* * * * *